US006155338A

United States Patent [19]

Endou et al.

[11] Patent Number: 6,155,338

[45] Date of Patent: Dec. 5, 2000

[54] HEAT EXCHANGER

[75] Inventors: Tsuneo Endou; Tsutomu Takahashi; Hideyuki Yanai; Toshiki Kawamura; Tokiyuki Wakayama, all of Saitama-ken, Japan

[73] Assignee: Honda Giken Kogyo Kabushiki Kaisha, Tokyo, Japan

[21] Appl. No.: 08/849,916

[22] PCT Filed: Jul. 26, 1996

[86] PCT No.: PCT/JP96/02115

§ 371 Date: May 29, 1997

§ 102(e) Date: May 29, 1997

[87] PCT Pub. No.: WO97/06395

PCT Pub. Date: Feb. 20, 1997

[30] Foreign Application Priority Data

Jul. 28, 1995 [JP] Japan ..... 7-193204

[51] Int. Cl.[7] ..... F28D 9/00

[52] U.S. Cl. ..... 165/165; 165/DIG. 399

[58] Field of Search ..... 165/165, 166

[56] References Cited

U.S. PATENT DOCUMENTS

| | | | |
|---|---|---|---|
| 2,945,680 | 7/1960 | Slemmons | 257/245 |
| 4,043,388 | 8/1977 | Zebuhr | 165/166 |
| 4,178,991 | 12/1979 | Bieri | 165/166 |
| 4,314,607 | 2/1982 | DesChamps | 165/69 |
| 4,338,998 | 7/1982 | Goloff | 165/157 |
| 4,343,355 | 8/1982 | Goloff et al. | 165/166 |
| 4,384,611 | 5/1983 | Fung | 165/157 |
| 4,527,622 | 7/1985 | Weber | 165/166 |
| 4,609,039 | 9/1986 | Fushiki | 165/174 |
| 5,060,721 | 10/1991 | Darragh | 165/166 |
| 5,065,816 | 11/1991 | Darragh | 165/166 |
| 5,081,834 | 1/1992 | Darragh | 165/125 |
| 5,082,050 | 1/1992 | Darragh | 165/81 |
| 5,303,771 | 4/1994 | DesChamps | 165/166 |
| 5,340,664 | 8/1994 | Hartvigsen | 429/20 |

FOREIGN PATENT DOCUMENTS

| | | | |
|---|---|---|---|
| 444542 | 2/1942 | Belgium . | |
| 796986 | 9/1997 | European Pat. Off. . | |
| 1208367 | 2/1960 | France | 165/165 |
| 2408462 | 8/1975 | Germany . | |
| 4333904 | 3/1995 | Germany . | |
| 56-149583 | 11/1981 | Japan . | |
| 57-2982 | 1/1982 | Japan . | |
| 57-2983 | 1/1982 | Japan . | |
| 58-40116 | 3/1983 | Japan . | |
| 320279 | 10/1929 | United Kingdom . | |
| 81/02060 | 7/1981 | WIPO . | |

OTHER PUBLICATIONS

English language abstract of JP 57/2983.

*Primary Examiner*—Allen Flanigan
*Attorney, Agent, or Firm*—Lyon & Lyon LLP

[57] ABSTRACT

First heat transfer plates S1 and second heat transfer plates S2 folded along crest folding lines L1 and valley folding lines L2 are bonded to an inner periphery of an outer casing 6 and an outer periphery of an inner casing 7, so that the first and second heat transfer plates S1 and S2 are disposed radiately, thereby forming combustion gas passages and air passages circumferentially alternately. One end of both the combustion gas passages and the air passages is cut into an angle shape, and one side and the other side of the angle shape are closed to form combustion gas passage inlets 11 and air passage outlets 16. In a similar manner, combustion gas passage outlets 12 and air passage inlets 15 are formed at the other end of the combustion gas passages and the air passages. Thus, it is possible to provide a heat exchanger which has a simple structure and is easy to manufacture, and in which the pressure loss due to bending of flow paths can be suppressed to the minimum.

14 Claims, 12 Drawing Sheets

HEAT EXCHANGER

BACKGROUND OF THE INVENTION

1. Field of the Invention

The present invention relates to a heat exchanger in which high-temperature fluid passages and low-temperature fluid passages are circumferentially alternately formed.

2. Description of the Related Art

There are conventionally known heat exchangers including high-temperature fluid passages and low-temperature fluid passages defined in an annular space, which are described in Japanese Patent Application Laid-open Nos. 57-2982, 57-2983 and 56-149583.

There is also a conventionally known heat exchanger described in Japanese Patent Application Laid-open No. 58-40116, in which a folding plate blank composed of a plurality of first heat transfer plates and a plurality of second heat transfer plates alternately continuously formed to each other through first and second folding lines are folded into a zigzag fashion at the first and second folding lines, a gap between the adjacent first folding lines being closed by bonding of the first folding lines and a first end plate, a gap between the adjacent second folding lines being closed by bonding of the second folding line and a second end plate, and high-temperature fluid passages and low-temperature fluid passages are alternately formed between the adjacent first and second heat transfer plates.

The heat exchangers described in Japanese Patent Application Laid-open Nos. 57-2982 and 57-2983 have a problem that the folding lines in the folding plate blank constituting the heat transfer plates are complicated and for this reason, a great deal of labor is required for a folding operation to increase a working cost. Another problem is that inlets of the high-temperature and low-temperature fluid passages open in a direction perpendicular to axes (i.e., radially) and hence, the flow of the fluid is abruptly bent at such open portions to produce a pressure loss. The heat exchangers described in Japanese Patent Application Laid-open No. 56-149583 has a problem that the direction of flow paths at the inlets and outlets is perpendicular to the direction of flow paths in the high-temperature or low-temperature fluid passages and hence, the flow of the fluid is abruptly bent at such perpendicular portion to produce a pressure loss. Further, in this heat exchanger, ducts are connected to the inlets and outlets permitting the fluid to flow radially. Therefore, there is a problem that it is difficult to form the ducts along an axial direction of the heat exchanger, resulting in an increase in radial dimension of the heat exchanger.

The heat exchanger described in Japanese Patent Application Laid-open No. 58-40116 has a problem that the sectional area of the flow path is constricted to about one half at the outlets and inlets of the high-temperature and low-temperature fluid passages, resulting in a great pressure loss produced at such portion. Moreover, the heat exchanger also has another problem that the outlets and inlets are formed by folding the folding plate blank and hence, the folding lines are complicated, resulting in a great deal of labor required for the folding operation to increase the manufacture cost. A further problem is that if the difference in pressure between the high-temperature or low-temperature fluid passages is large, a spacer is inserted between the first and second heat transfer plates to maintain the strength, resulting in increases in number of parts and in number of assembling steps by such a spacer. Further, the fluid outlet and inlet formed adjacent each other are intricate with each other and hence, if an attempt is made to partition the outlet and inlet by a partition member, the structure of the partition member becomes complicated, and the area of the bond area such as the brazed area is increased, resulting in a possibility of a fluid leakage being produced.

SUMMARY OF THE INVENTION

The present invention has been accomplished with the above circumstances in view, and it is a first object of the present invention to provide a heat exchanger which has a simple structure, so that the heat exchanger is easy to manufacture and, wherein the pressure loss due to the bending of the flow path can be suppressed to the minimum.

It is a second object of the invention to provide a heat exchanger, wherein the pressure loss due to the bending of the flow path can be suppressed to minimum and moreover, the radial dimension can be decreased.

It is a third object of the invention to provide a heat exchanger, wherein the sectional area of the flow paths at the outlets and inlets of fluid passages can sufficiently be insured to suppress the pressure loss to the minimum and moreover, the outlets and inlets can be formed by a means other than the folding of the folding plate blank.

It is a fourth object of the invention to provide a heat exchanger, wherein the sectional area of the flow paths at the outlets and inlets of fluid passages can sufficiently be insured to suppress the pressure loss to the minimum and moreover, the accuracy and strength of the heat transfer plates can be maintained without increases in number of parts and number of assembling steps.

It is a fifth object of the invention to provide a heat exchanger, wherein the sectional area of the flow paths at the outlets and inlets of fluid passages can sufficiently be insured to suppress the pressure loss to the minimum and moreover, it is easy to partition the outlet and the inlet by a partition member.

To achieve the first object, according to the invention, there is provided a heat exchanger comprising axially extending high-temperature and low-temperature fluid passages formed circumferentially alternately in an annular space defined between a radially outer peripheral wall and a radially inner peripheral wall, wherein by folding a folding plate blank comprised of a plurality of first heat transfer plates and a plurality of second heat transfer slates connected alternately through folding lines, in a zigzag fashion, so that the first and second heat transfer plates are disposed radiately between the radially outer and inner peripheral walls, the high-temperature and low-temperature fluid passages are formed circumferentially alternately between the adjacent first and second heat transfer plates, and high-temperature fluid passage inlets and high-temperature fluid passage outlets are formed to open into axially opposite ends of the high-temperature fluid passages, and low-temperature fluid passage inlets and low-temperature fluid passage outlets are formed to open into axially opposite ends of the low-temperature fluid passages.

With such arrangement, it is possible not only to substantially reduce the number of the heat transfer plates of the heat exchanger to possibly decrease the bonding portions between the heat transfer plates, but also to easily and accurately maintain the axial symmetry of the heat exchanger. Moreover, flow paths of the high-temperature and low-temperature fluid passages do not bend abruptly at the inlets and the outlets and hence, it is possible to suppress the increase in flow path resistance to reduce the pressure loss.

To achieve the second object, according to the invention, there is provided a heat exchanger comprising a plurality of first heat transfer plates and a plurality of second heat transfer plates disposed radiately in an annular space defined between a radially outer peripheral wall and a radially inner peripheral wall, thereby forming high-temperature and low-temperature fluid passages circumferentially alternately between the adjacent first and second heat transfer plates, wherein the heat exchanger further includes high-temperature fluid passage inlets formed by cutting axially opposite ends of the first and second heat transfer plates into an angle shape having two end edges, and closing one of the two end edges at axially one end of the high-temperature fluid passages and opening the other end edge, high-temperature fluid passage outlets formed by closing the one end edge at the axially other end of the high-temperature fluid passages and opening the other end edge, low-temperature fluid passage inlets formed by closing the other end edge at the axially other end of the low-temperature fluid passages and opening the one end edge, and low-temperature fluid passage outlets formed by closing the other end edge at axially one end of the low-temperature fluid passages and opening the one end edge.

With the above arrangement, a high-temperature fluid and a low-temperature fluid can be permitted to flow in opposite directions to provide an enhanced heat exchange efficiency. Flow paths of the high-temperature and low-temperature fluid passages are smoothly formed, but also sectional area of flow paths in the inlets and outlets can sufficiently be insured to suppress the generation of a pressure loss to the minimum. Further, the flow paths connected to the outsides of the inlets and the outlets can be easily formed to extend axially, thereby reducing the radial dimension of the heat exchanger, but also the inlets and outlets can be easily separated from each other to avoid the mixing of the high-temperature and low-temperature fluids.

To achieve the third object, according to the invention, there is provided a heat exchanger which is formed from a folding plate blank comprised of a plurality of first heat transfer plates and a plurality of second heat transfer plates connected alternately through first and second folding lines, and which comprises high-temperature fluid passages and low-temperature fluid passages formed alternately between the adjacent first and second heat transfer plates by folding the folding plate blank in a zigzag fashion, so that a space between the adjacent first folding lines is closed by bonding of the first folding lines and a first end plate and a space between the adjacent second folding lines is closed by bonding of the second folding lines and a second end plate, wherein the heat exchanger further includes high-temperature fluid passage inlets formed by cutting opposite ends of the first and second heat transfer plates in a flow path direction into an angle shape having two end edges, closing one of the two end edges at one end of the high-temperature fluid passages in the flow path direction by projection stripes provided on the first and second heat transfer plates and opening the other end edge, high-temperature fluid passage outlets formed by closing the one end edge at the other end of the high-temperature fluid passages by the projection stripes provided on the first and second heat transfer plates and opening the other end edge, low-temperature fluid passage inlets formed by closing the other end edge at the other end of the low-temperature fluid passages in the flow path direction by the projection stripes provided on the first and second heat transfer plates and opening the one end edge, and low-temperature fluid passage outlets formed by closing the other end edge at one end of the low-temperature fluid passages by the projection stripes provided on the first and second heat transfer plates and opening the one end edge.

With the above arrangement, a high-temperature fluid and a low-temperature fluid can be permitted to flow in opposite directions to provide an enhanced heat exchange efficiency. Flow paths of the high-temperature and low-temperature fluid passages can be smoothly formed, and the sectional area of the flow paths at the inlets and the outlets can sufficiently be insured to suppress the pressure loss to the minimum and moreover, the inlets and the outlets can be easily separated from each other to avoid the mixing of the high-temperature and low-temperature fluids. Further, the need for folding the folding plate blank to form the inlets and the outlets can be eliminated to contribute to a reduction in manufacture cost.

To achieve the fourth object, according to the invention, there is provided a heat exchanger which is formed from a folding plate blank comprised of a plurality of first heat transfer plates and a plurality of second heat transfer plates connected alternately through first and second folding lines, and which comprises high-temperature fluid passages and low-temperature fluid passages formed alternately between the adjacent first and second heat transfer plates by folding the folding plate blank in a zigzag fashion along the first and second folding lines, so that a space between the adjacent first folding lines is closed by bonding of the first folding lines and a first end plate and a space between the adjacent second folding lines is closed by bonding of the second folding lines and a second end plate, wherein the heat exchanger further includes high-temperature fluid passage inlets formed by cutting opposite ends of the first and second heat transfer plates in a flow path direction into an angle shape having two end edges, closing one of the two end edges at one end of the high-temperature fluid passages in the flow path direction and opening the other end edge, high-temperature fluid passage outlets formed by closing the one end edge at the other end of the high-temperature fluid passages and opening the other end edge, low-temperature fluid passage inlets formed by closing the other end edge at the other end of the low-temperature fluid passages in the flow path direction and opening the one end edge, low-temperature fluid passage outlets formed by closing the other end edge at the one end of the low-temperature fluid passages and opening the one end edge, and a large number of projections formed on opposite surfaces of the first and second heat transfer plates, tip ends of the projections on the adjacent first and second heat transfer plates being brought into abutment against each other and bonded to each other.

With the above arrangement, a high-temperature fluid and a low-temperature fluid can be permitted to flow in opposite directions to provide an enhanced heat exchange efficiency. Flow paths of the high-temperature and low-temperature fluid passages can be smoothly formed, and the sectional area of flow paths at the inlets and the outlets can sufficiently be insured to suppress the pressure loss to the minimum. Moreover, the inlets and the outlets can be easily separated from each other to avoid the mixing of the high-temperature and low-temperature fluids. Further, it is possible not only to position the first and second heat transfer plates at correct distances, but also to prevent the flexure of the first and second heat transfer plates due to a difference in pressure between the high-temperature and low-temperature fluid passages, thereby provide an increase in dimensional accuracy and an increase in strength of the heat exchanger.

To achieve the fifth object, according to the invention, there is provided a heat exchanger which is formed from a folding plate blank comprised of a plurality of first heat transfer plates and a plurality of second heat transfer plates connected alternately through first and second folding lines, and which comprises high-temperature fluid passages and low-temperature fluid passages formed alternately between the adjacent first and second heat transfer plates by folding the folding plate blank in a zigzag fashion along the first and second folding lines, so that a space between the adjacent first folding lines is closed by bonding of the first folding lines and a first end plate and a space between the adjacent second folding lines is closed by bonding of the second folding lines and a second end plate, wherein the heat exchanger further includes high-temperature fluid passage inlets formed by cutting opposite ends of the first and second heat transfer plates in a flow path direction into an angle shape having two end edges, closing one of the two end edges at one end of the high-temperature fluid passages in the flow path direction and opening the other end edge, high-temperature fluid passage outlets formed by closing the one end edge at the other end of the high-temperature fluid passages and opening the other end edge, low-temperature fluid passage inlets formed by closing the other end edge at the other end of the low-temperature fluid passages in the flow path direction and opening the one end edge, low-temperature fluid passage outlets formed by closing the other end edge at one end of the low-temperature fluid passages and opening the one end edge, partition plates each bonded to an apex of the angle shape at the one end in the flow path direction to partition the high-temperature fluid passage inlets and the low-temperature fluid passage outlets from each other, and partition plates each bonded to an apex of the angle shape at the other end in the flow path direction to partition the low-temperature fluid passage inlets and the high-temperature fluid passage outlets.

With the above arrangement, a high-temperature fluid and a low-temperature fluid can be permitted to flow in opposite directions to provide an enhanced heat exchange efficiency. Flow paths of the high-temperature and low-temperature fluid passages can be smoothly formed, and the sectional area of flow paths at the inlets and the outlets can sufficiently be insured to suppress the pressure loss to the minimum. Moreover, the inlets and the outlets can be easily separated from each other to avoid the mixing of the high-temperature and low-temperature fluids. Further, the reduction in sectional area of the flow paths at the inlets and the outlets due to the partition plates can be suppressed to the minimum and moreover, the area of bond portions between the first and second heat transfer plates and the partition plates can be suppressed to the minimum to diminish the possibility of a fluid leakage.

BRIEF DESCRIPTION OF THE DRAWINGS

FIGS. 1 to 12 illustrate a first embodiment of the present invention, wherein FIG. 1 is a side view of the entire arrangement of the heat exchanger 4 a gas turbine engine;

FIG. 2 is a sectional view taken along the line 2—2 in FIG. 1;

FIG. 3 is an enlarged sectional view taken along the line 3—3 in FIG. 2 (a sectional view of combustion gas passages);

FIG. 4 is an enlarged sectional view taken along the line 4—4 in FIG. 2 (a sectional view of air passages);

FIG. 5 is an enlarged sectional view taken along the line 5—5 in FIG. 3;

FIG. 6 is an enlarged view of a portion indicated by 6 in FIG. 5;

FIG. 7 is an enlarged sectional view taken along the line 7—7 in FIG. 3;

FIG. 8 is an enlarged view of a portion indicated by 8 in FIG. 7;

FIG. 9 is an enlarged sectional view taken along the line 9—9 in FIG. 3;

FIG. 10 is a developed view of a folding plate;

FIG. 11 is a perspective view of an essential portion of a heat exchanger;

FIG. 12 is a diagram illustrating flows of a combustion gas and air; and

DETAILED DESCRIPTION OF THE PREFERRED EMBODIMENTS

A first embodiment of the present invention will now be described with reference to FIGS. 1 to 12.

Figure 1:
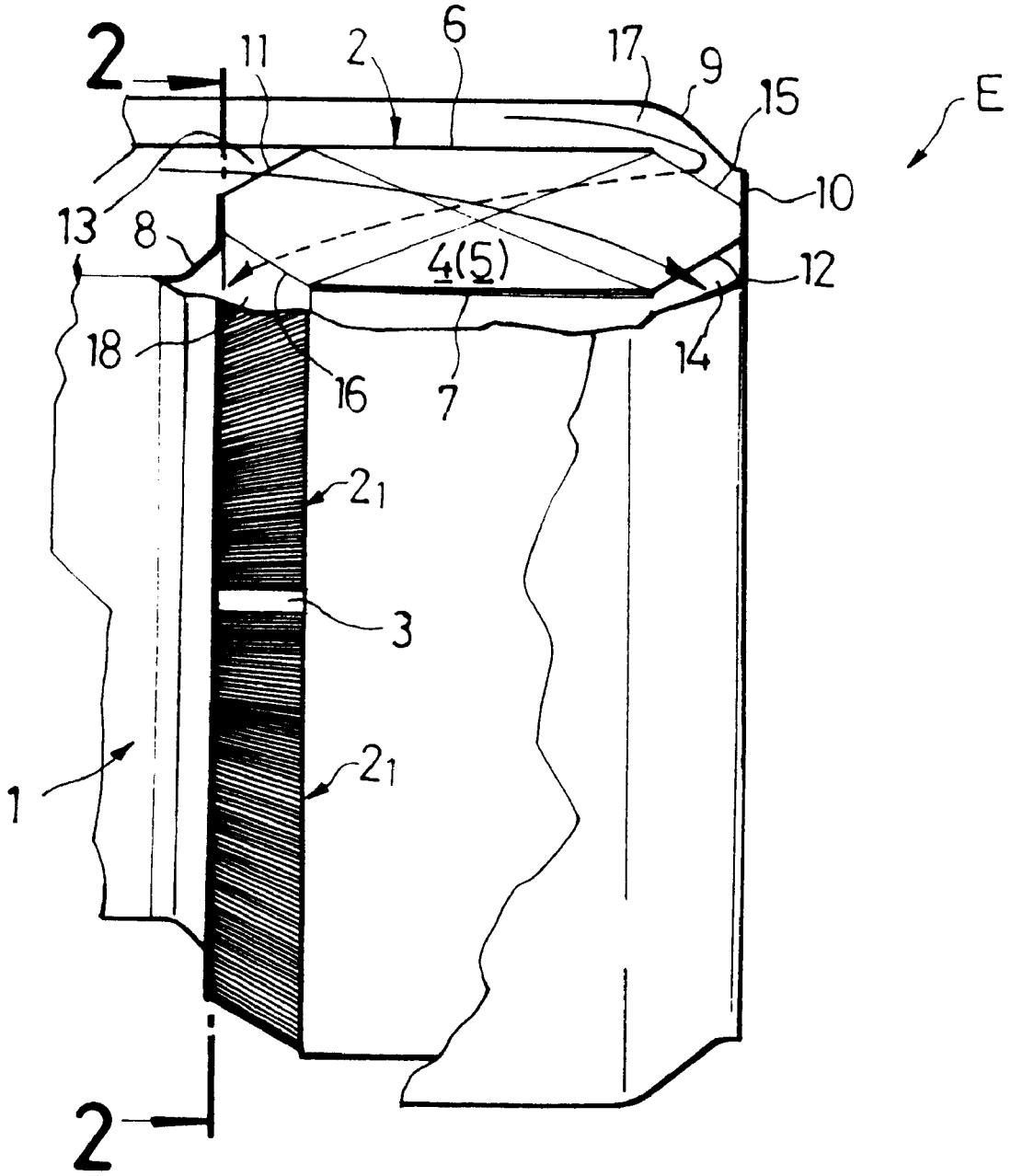
Figure 2:
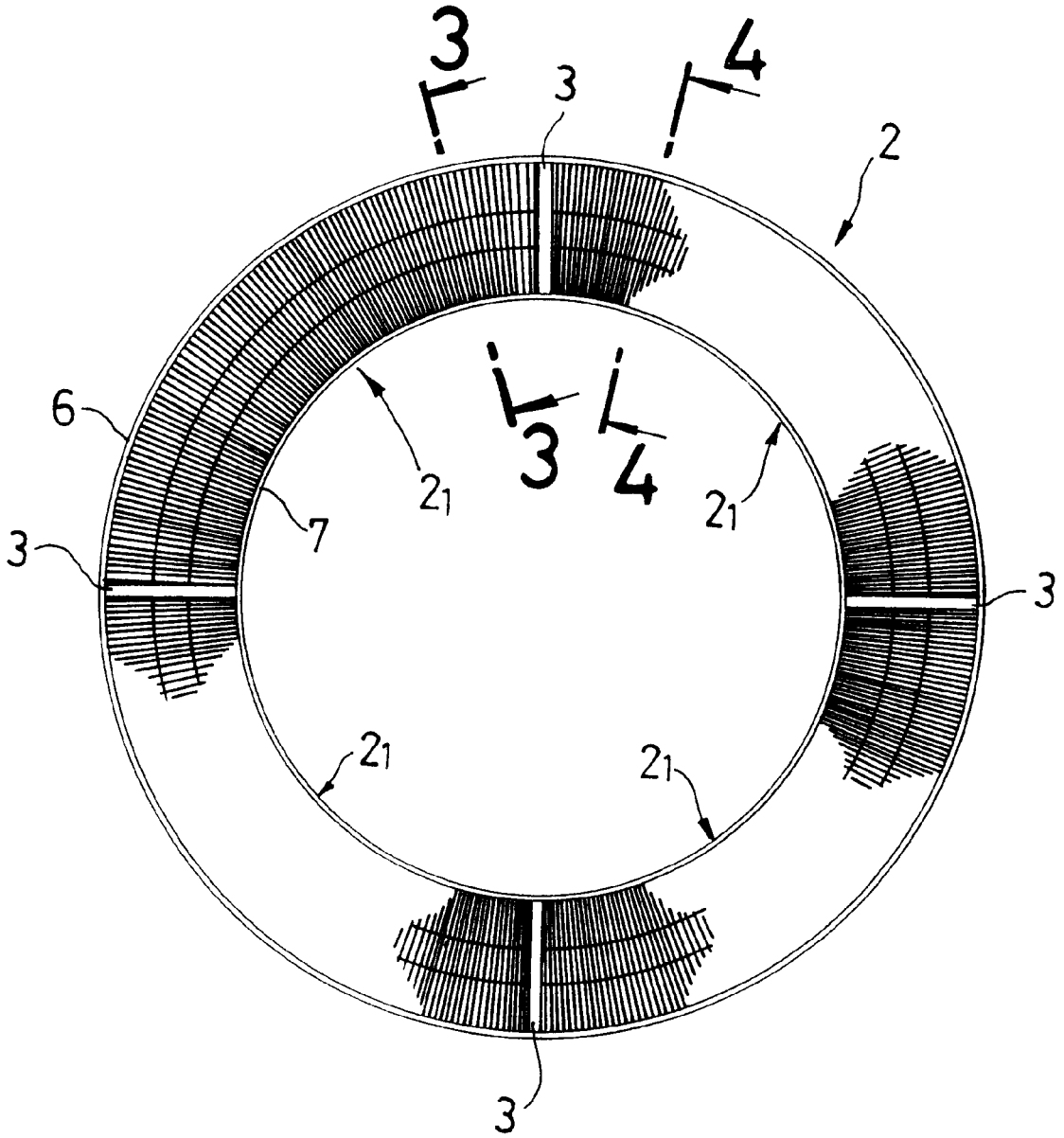

As shown in FIGS. 1 and 2, a gas turbine engine E includes an engine body 1 in which a combustor, a compressor, turbine and the like (not shown) are accommodated. An annular heat exchanger 2 is disposed to surround an outer periphery of the engine body 1. The heat exchanger 2 includes four modules $\mathbf{2}_1$, having a center angle of 90° and arranged circumferentially with side plates 3 sandwiched between the adjacent modules, and further includes combustion gas passages 4 (see FIG. 3) through which a combustion gas of relatively high temperature passed through the turbine is passed, and air passages 5 (see FIG. 4) through which air of relatively low temperature compressed in the compressor is passed. The fluid passages 4 and 5 are formed circumferentially alternately (see FIGS. 5 to 9). A section in FIG. 1 corresponds to the combustion gas passage 4, and the air passages 5 are formed on this side and on the far side of the combustion gas passage 4.

The section shape of the heat exchanger 2 extending along an axis is of an axially longer and radially shorter flat hexagonal shape. A radially outer peripheral surface of the heat exchanger 2 is closed by a cylindrical outer casing 6 of a larger diameter, and a radially inner peripheral surface is closed by a cylindrical inner casing 7 of a smaller diameter. A front end side (a left side in FIG. 1) in the section of the heat exchange 2 is cut into an angle shape, and an end plate 8 is brazed to an end face corresponding to an apex of the angle shape and connected to the outer periphery of the engine body 1. A rear end side (a right side in FIG. 1) in the section of the heat exchange 2 is also cut in an angle shape, and an end plate 10 is brazed to an end face corresponding to the apex of the angle shape and connected to a rear outer housing 9.

Each of the combustion gas passages 4 in the heat exchanger 2 includes a combustion gas passage inlet 11 and a combustion gas passage outlet 12 at left and right upper locations in FIG. 1. A downstream end of a combustion gas introducing duct 13 formed along the outer periphery of the engine body 1 is connected to the combustion gas passage inlet 11, and an upstream end of a combustion gas discharging duct 14 extending within the engine body 1 is connected to the combustion gas passage outlet 12.

Each of the air passages 5 in the heat exchange 2 includes an air passage inlet 15 and an air passage outlet 16 at right and left lower locations in FIG. 1. A downstream end of an air introducing duct 17 formed along an inner periphery of the rear outer housing 9 is connected to the air passage inlet 15, and an air discharging duct 18 extending within the engine body 1 is connected to the air passage outlet 16.

Figure 3:
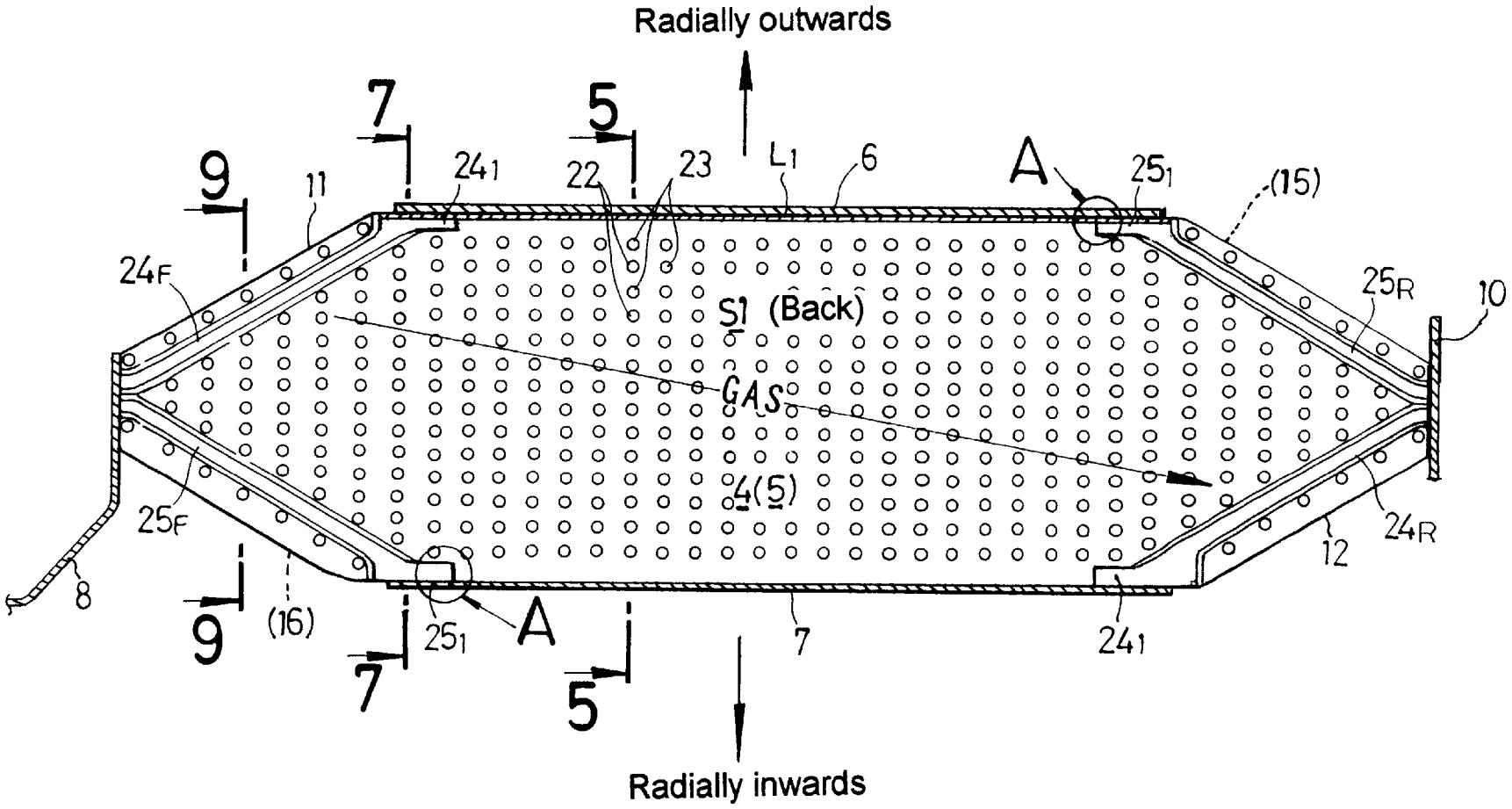
Figure 4:
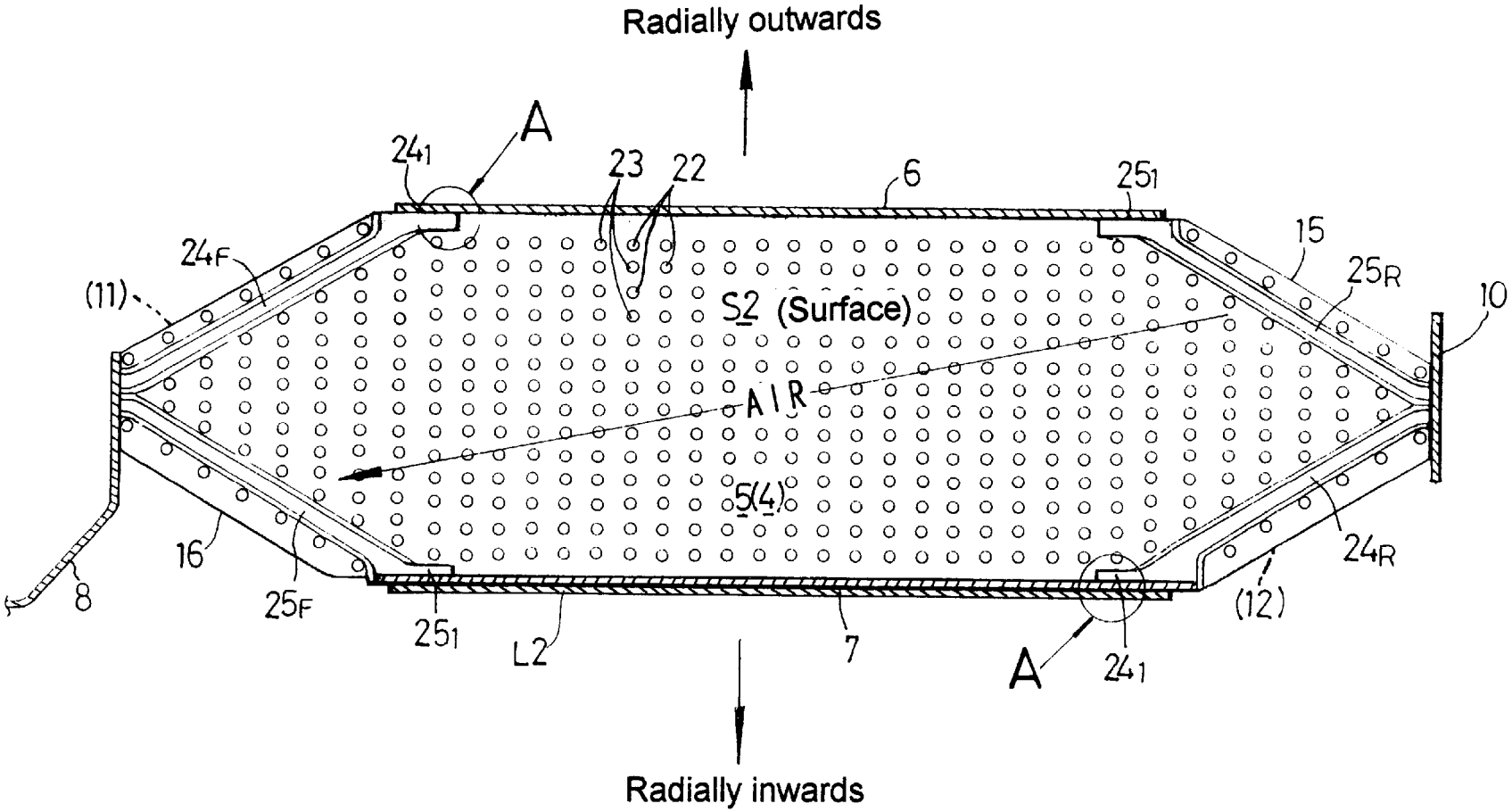
Figure 12:
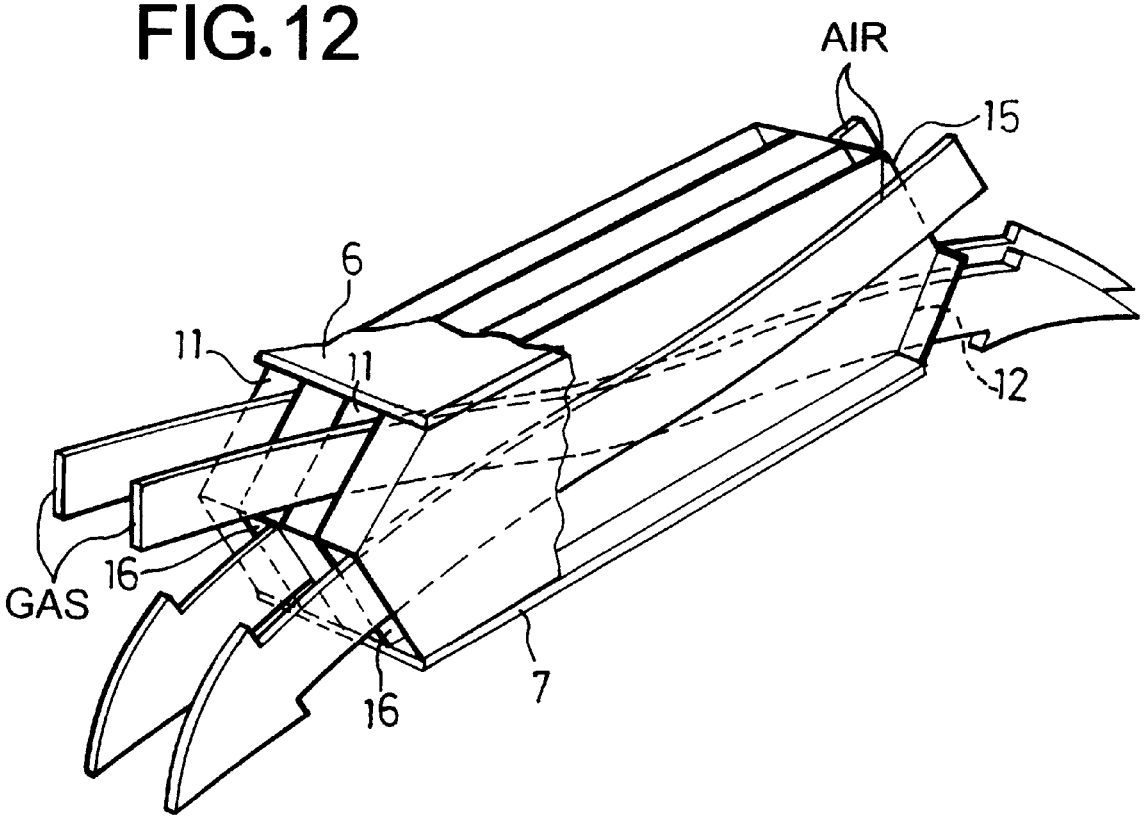

In this manner, combustion gas and air flow in opposite directions and cross each other, as shown in FIGS. 3, 4 and 12, thereby realizing a so-called "cross-flow" having a high heat-exchange efficiency. That is, by permitting a higher-temperature fluid and a lower-temperature fluid to flow in opposite directions, a large difference in temperature between the higher-temperature fluid and the lower-temperature fluid can be maintained over the entire length of flow paths of the fluids to enhance the heat exchange efficiency.

The temperature of the combustion gas which has driven the turbine is about 600 to 700° C. in the combustion gas passage inlets 11, and the combustion gas is cooled down to about 300 to 400° C. in the combustion gas passage outlets 12 by conducting a heat exchange between the combustion gas and the air when the combustion gas passes through the combustion gas passages 4. On the other hand, the temperature of the air compressed by the compressor is about 200 to 300° C. in the air passage inlets 15 and the air is heated up to about 500 to 600° C. in the air passage outlets 16—by conducting a heat exchange between the air and the combustion gas when the air passes through the air passages 5.

The structure of the heat exchanger 2 will be described below with reference to FIGS. 3 to 11.

Figure 10:
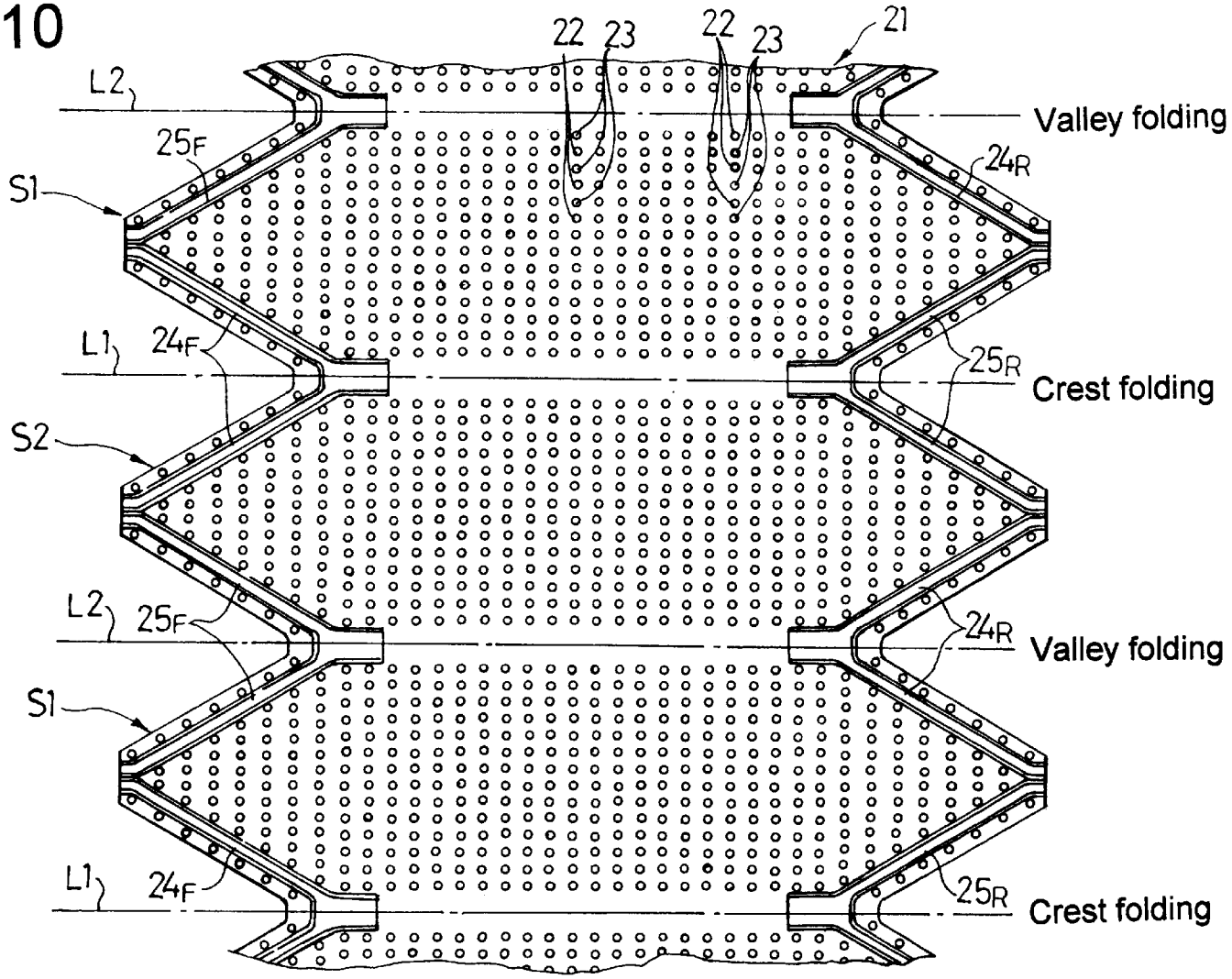

As shown in FIGS. 3, 4 and 10, each of the modules $\mathbf{2}_1$ of the heat exchanger 2 is made from a folding plate blank 21 produced by cutting a thin metal plate such as a stainless steel or the like into a predetermined shape and then forming an irregularity on a surface of the cut plate by pressing. The folding plate blank 21 is constructed of first heat transfer plates S1 and second heat transfer plates disposed alternately, and is folded into a zigzag shape through crest folding lines L1 and valley folding lines L2. The term "crest folding" means that the blank is folded into a convex toward this side of a paper sheet surface, and the term "valley folding" means that the blank is folded into a concave toward this side of the paper sheet surface. Each of the crest folding line L1 and the valley folding lines L2 is not a simple straight line, but actually, is two substantially parallel lines for the purpose of forming a predetermined space between the first and second heat transfer plates S1 and S2 and moreover, opposite ends thereof are folded lines departing from a straight line for the purpose of forming closed projections $\mathbf{24}_1$ and $\mathbf{25}_1$ which will be described hereinafter.

A large number of first projections 22 and a large number of second projections 23 disposed in a grid manner are formed on each of the first and second heat transfer plates S1 and S2 by pressing. The first projections 22 protrude toward this side of the paper sheet surface of FIG. 10, and the second projections 23 protrude toward the far side of the paper sheet surface of FIG. 10. The first projections 22 and the second projections 23 are disposed alternately (i.e., so that the first projections 22 are not continuous to one another or the second projections 23 are not continuous to one another.

First projection stripes $\mathbf{24}_F$ and $\mathbf{24}_R$ protruding toward this side of the paper sheet surface of FIG. 10 and second projection stripes $\mathbf{25}_F$ and $\mathbf{25}_R$ protruding toward the far side of the paper sheet surface of FIG. 10 are formed at the front an rear ends, following the angle shape, of the first and second heat transfer plates S1 and S2 by pressing. For any of the first and second heat transfer plates S1 and S2, a pair of the front and rear first projection stripes $\mathbf{24}_F$ and $\mathbf{24}_R$ are disposed at diagonal locations, and a pair of the front and rear second projection stripes $\mathbf{25}_F$ and $\mathbf{25}_R$ are disposed at other diagonal locations.

As can be seen from FIGS. 3 and 10, when the first and second heat transfer plates S1 and S2 of the folding plate blank 21 are folded along the crest folding lines L1 to form the combustion gas passages 4 between both the first and second heat transfer plates S1 and S2, tip ends of the second projections 23 of the first heat transfer plate S1 and tip ends of the second projections 23 of the second heat transfer plate S2 are brought into abutment against each other and brazed to each other. In addition, the second projection stripes $\mathbf{25}_F$ and $\mathbf{25}_R$ of the first heat transfer plate S1 and the second projection stripes $\mathbf{25}_F$ and $\mathbf{25}_R$ of the second heat transfer plate S2 are brought into abutment against each other and brazed, thereby closing left lower and right upper portions of the combustion gas passage 4 shown in FIG. 3, and the first projection stripes $\mathbf{24}_F$ and $\mathbf{24}_R$ of the first heat transfer plate S1 and the first projection stripes $\mathbf{24}_F$ and $\mathbf{24}_R$ of the second heat transfer plate S2 project away from each other, thereby defining the combustion gas passage inlet 11 and the combustion gas passage outlet 12 at the left upper and right lower portions of the combustion gas passage 4 shown in FIG. 3, respectively. For the first heat transfer plate S1 shown in FIG. 3, the back side thereof is shown based on the first heat transfer plate S1 shown in FIG. 10.

As can be seen from FIGS. 4 and 10, when the first heat transfer plates S1 and the second heat transfer plates S2 of the folding plate blank 21 are folded along the valley folding lines L2 to define the air passages 5 between adjacent first and second heat transfer plates S1 and S2, the tip ends of the first projections 22 of the first heat transfer plate S1 and the tip ends of the first projections 22 of the second heat transfer plate S2 are brought into abutment against each other and brazed to each other in addition, the first projection stripes $\mathbf{24}_F$ and $\mathbf{24}_R$ of the first heat transfer plate S1 and the first projection stripes $\mathbf{24}_F$ and $\mathbf{24}_R$ of the second heat transfer plate S2 are brought into abutment against each other and brazed to each other, thereby closing left upper and right lower portions of the air passage 5 shown in FIG. 4, and the second projection stripes $\mathbf{25}_F$ and $\mathbf{25}_R$ of the first heat transfer plate S1 and the second projection stripes $\mathbf{25}_F$ and $\mathbf{25}_R$ of the second heat transfer plate S2 project away from to each other to define the air passage inlet 15 and the air passage outlet 16 at the right upper and left lower portions of the air passage 5 shown in FIG. 4, respectively. For the second heat transfer plate S2 shown in FIG. 4, the surface side thereof is shown based on the second heat transfer plate S2 shown in FIG. 10.

Figure 9:
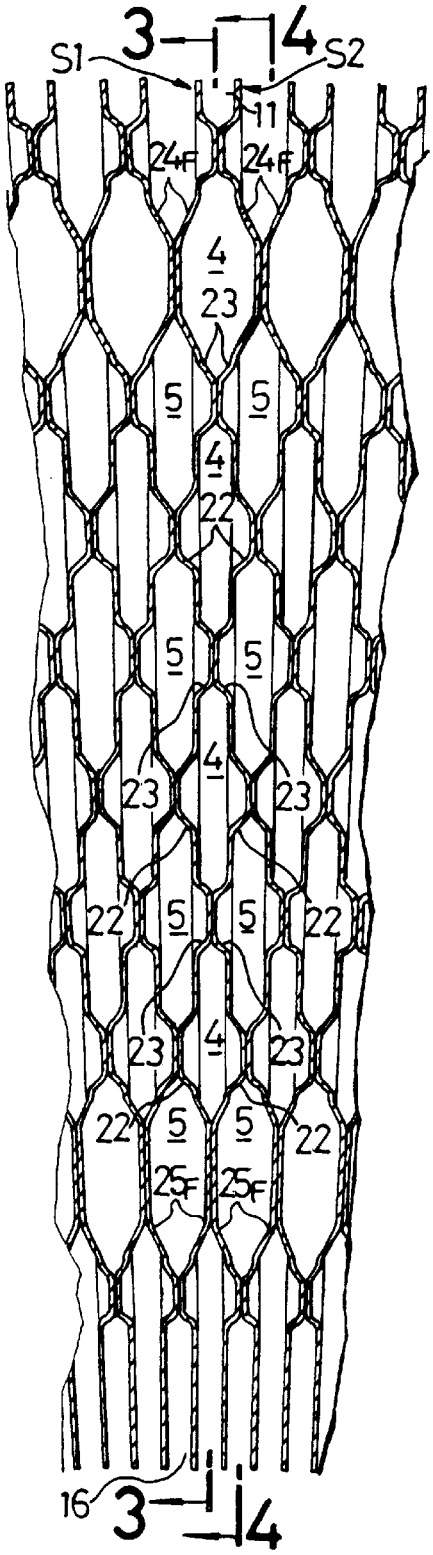

A state in which the air passages 5 have been closed by the first projection stripes $\mathbf{24}_F$ is shown in an upper portion (a radially outer side) of FIG. 9, and a state in which the combustion gas passages 4 have been closed by the second projection stripes $\mathbf{25}_F$ is shown in a lower portion (a radially inner side) of FIG. 9.

The first and second projections 22 and 23 each have a substantially truncated conical shape, and their tip end portions are brought into surface contact with each other in order to enhance the brazing strength which will be described hereinafter. The first and second projection stripes $\mathbf{24}_F$, $\mathbf{24}_R$ $\mathbf{25}_F$ and $\mathbf{25}_R$ each also have a substantially truncated conical section, and their tip end portions are also brought into surface contact with each other in order to enhance the brazing strength.

Figure 11:
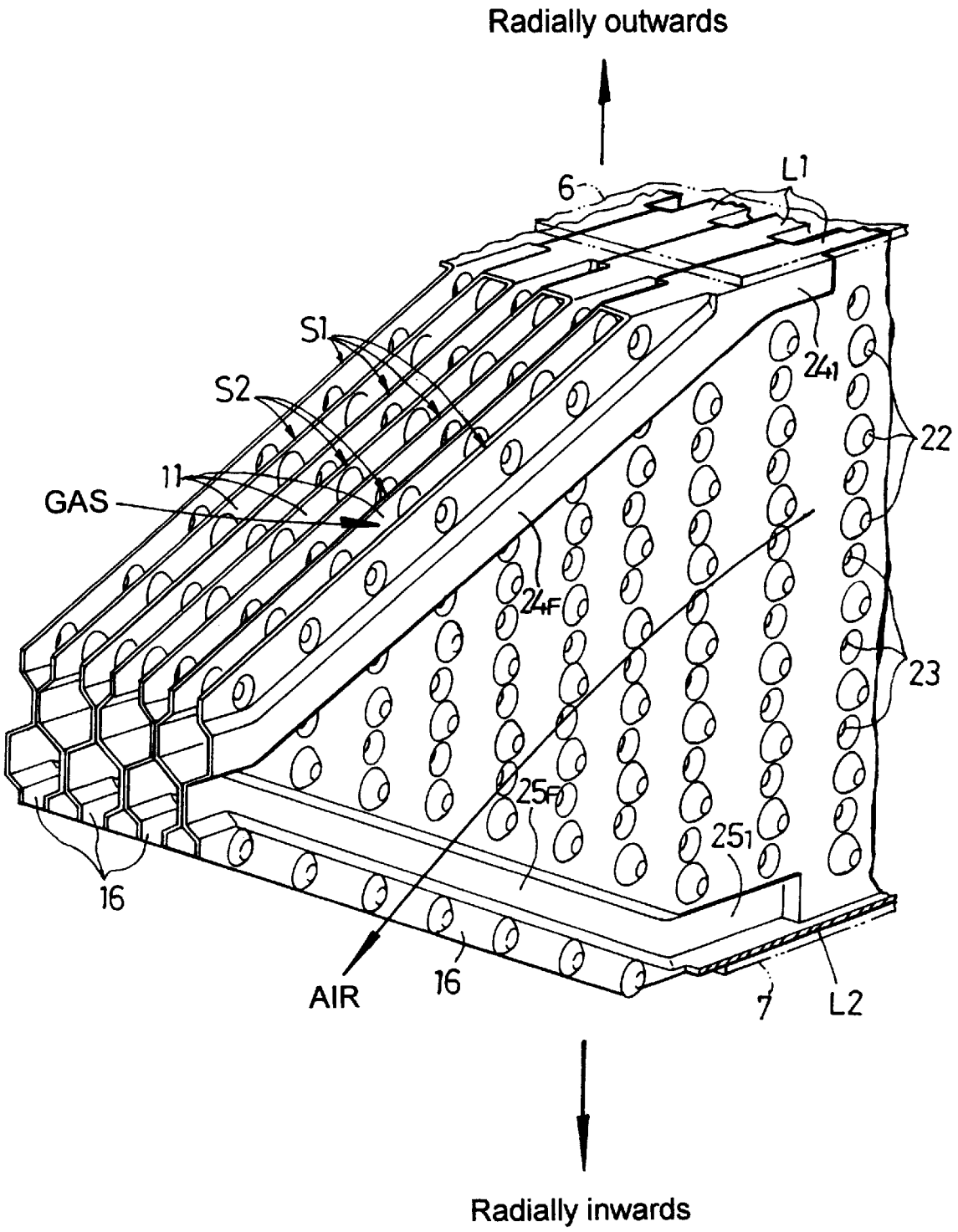

As can be seen from FIGS. 3, 4 and 11, when the folding plate blank 21 is folded in a zigzag fashion, closing projections $\mathbf{24}_1$ and $\mathbf{25}_1$ are formed at axially inner ends (portions connected to the crest folding lines L1 and the valley folding lines L2) of the first and second projection stripes $\mathbf{24}_F$, $\mathbf{24}_R$ $\mathbf{25}_F$ and $\mathbf{25}_R$ to extend integrally from the first and second projection stripes $\mathbf{24}_F$, $\mathbf{24}_R$ $\mathbf{25}_F$ and $\mathbf{25}_R$. When the tip ends of the opposed first projection stripes $\mathbf{24}_F$ and $\mathbf{24}_R$ have been bonded to each other, the tip ends of the closing projections $24_1$ connected to the first projection stripes $24_F$ and $24_F$ are also bonded to each other. When the tip ends of the opposed second projection stripes $25_F$ have been bonded to each other, the tip ends of the closing projections $25_1$ connected to the second projection stripes $25_F$ are also bonded to each other. The radially inner surface of the outer casing 6 and the radially outer peripheral surface of the inner casing 7 are connected to the radially outer and inner peripheral surfaces of the bonded closing projections $24_1$ and $25_1$, respectively.

Figure 7:
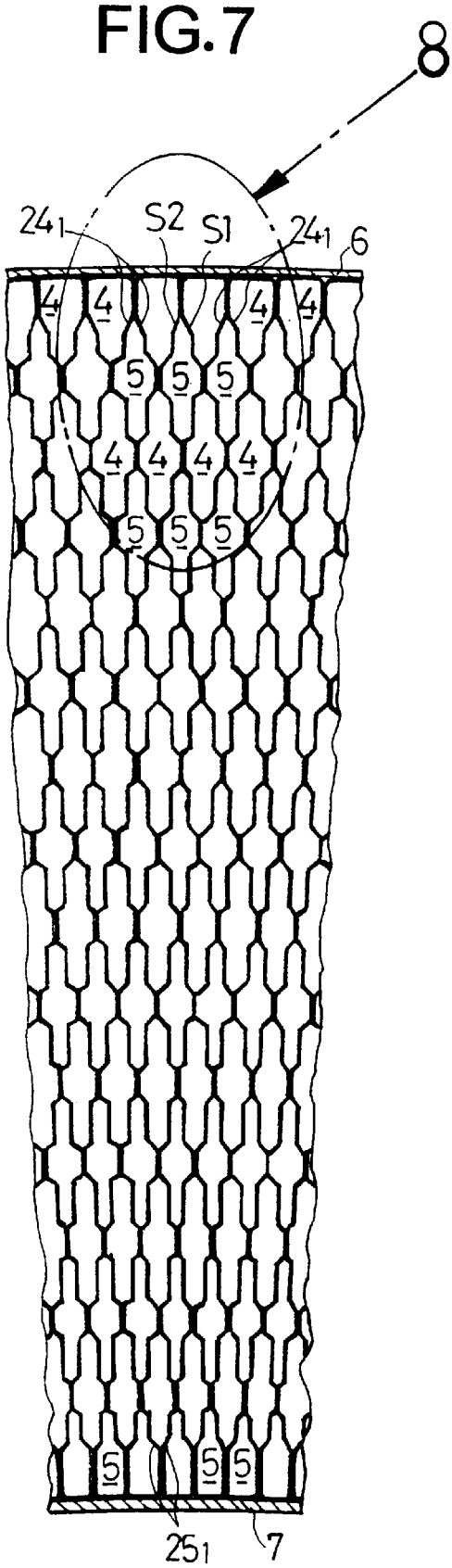
Figure 8:
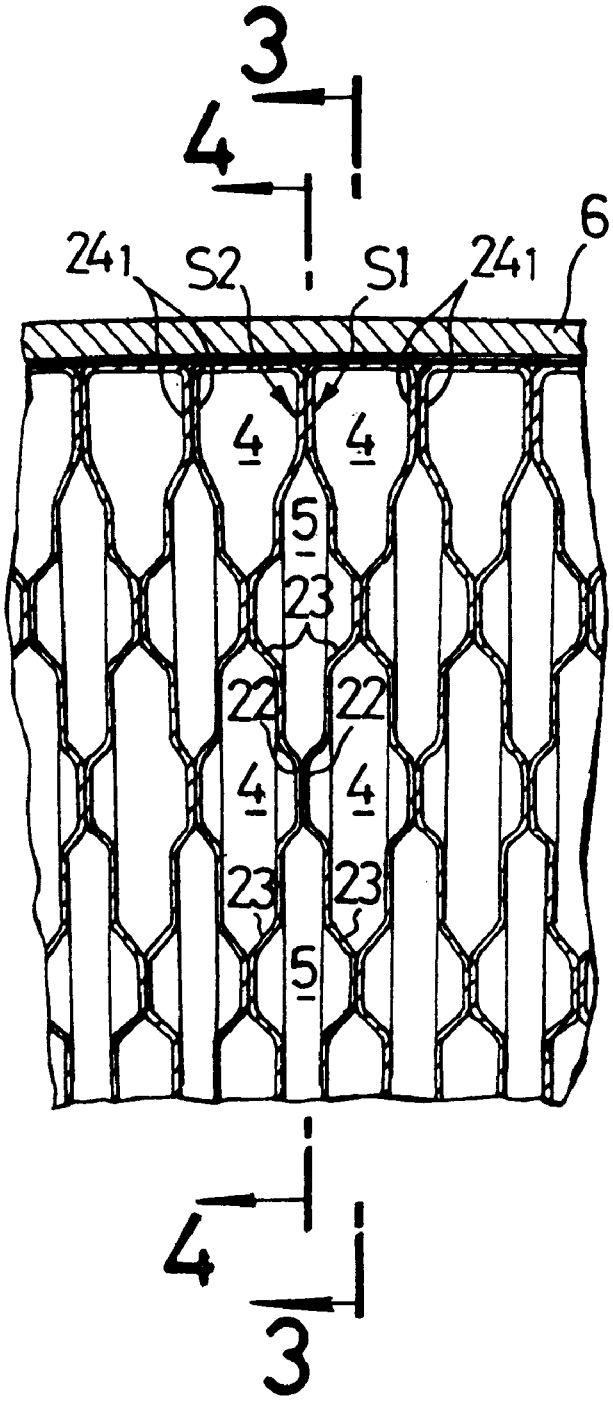

A state in which each of the air passages 5 has been closed by the closing projections $24_1$ is shown in an upper portion (a radially outer portion) of FIG. 7 and in FIG. 8. A state in which the combustion gas passages 4 have been closed by the closing projections $25_1$ is shown in a lower portion (a radially inner portion) of FIG. 7. The closing of the air passages 5 by the closing projections $24_1$ is also shown in a portion A of FIG. 4, and the closing of the combustion gas passages 4 by the closing projections $25_1$ is also shown in a portion A of FIG. 3.

Figure 5:
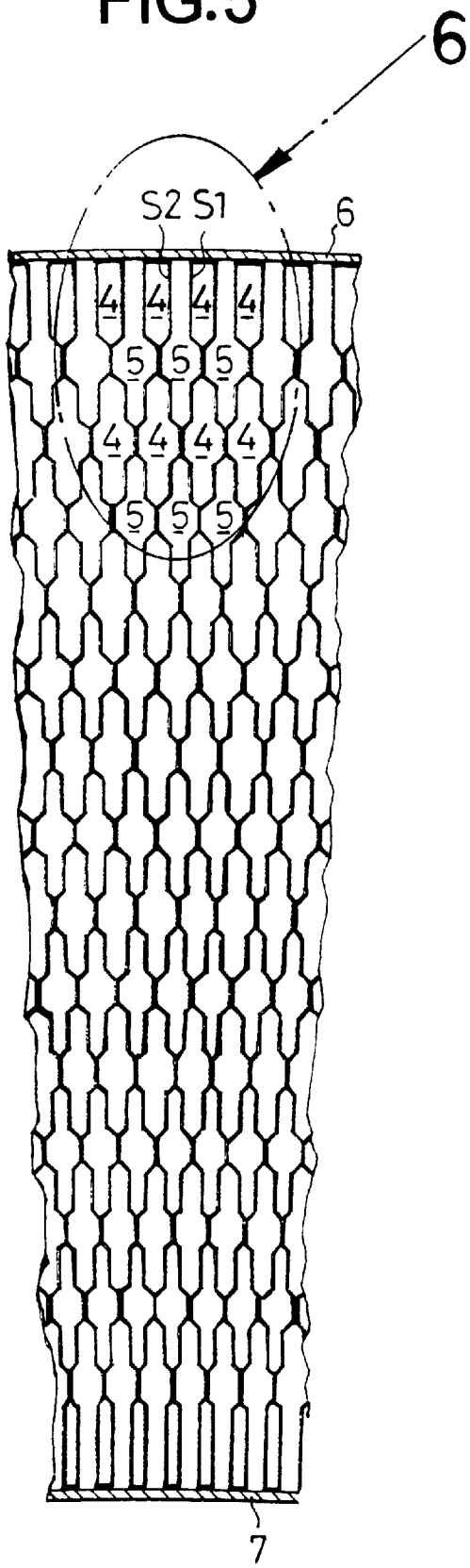
Figure 6:
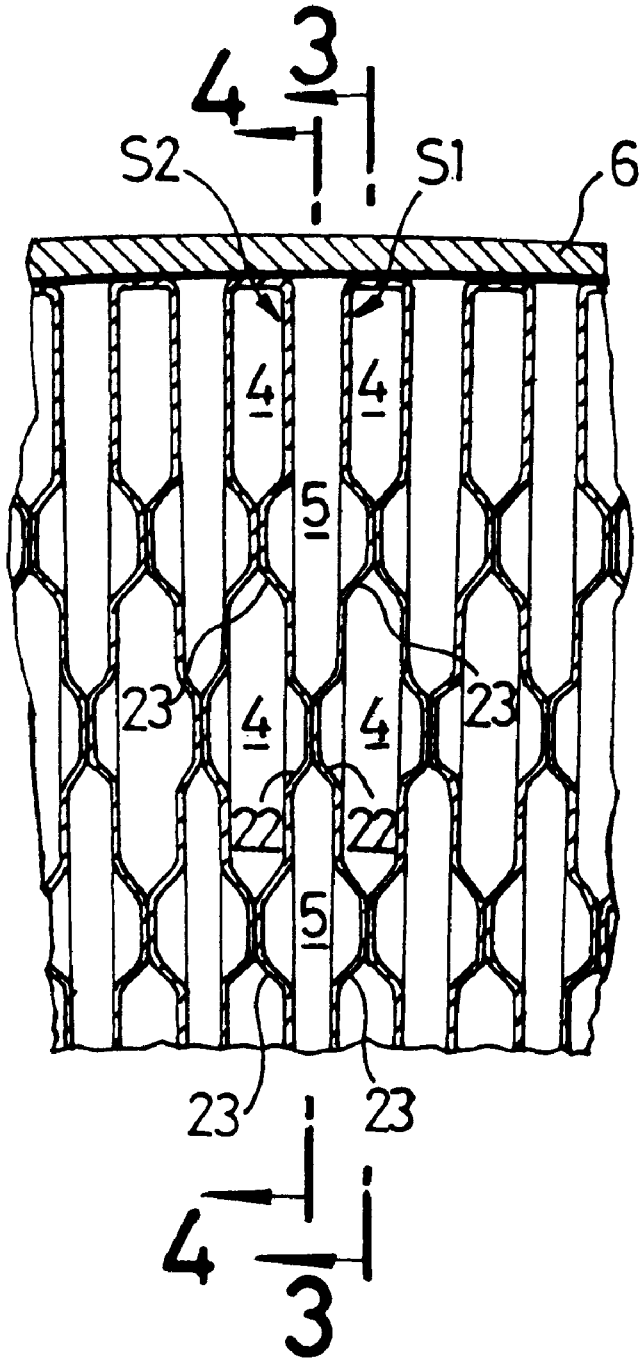

As can be seen from FIGS. 5 and 6, radially inner peripheral portions of the air passages 5 are automatically closed because they correspond to folded portions (the valley folding lines L2) of the folding plate blank 21, but radially outer portions of the air passages 5 are open, and such open portions are closed by the outer casing 6. On the other hand, radially outer peripheral portions or the combustion gas passages 4 are automatically closed because they correspond to folded portions (the crest folding lines L1) of the folding plate blank 21, but radially inner peripheral portions of the combustion gas passages 4 are open, and such open portions are closed by the inner casing 7.

In this way, the heat exchange efficiency is enhanced by disposing the combustion gas passages 4 and the air passages 5 alternately in the circumferential direction in the widest possible area extending along the radially outer and inner peripheral portions of the heat exchanger 2 (see FIG. 5).

When the modules 21 of the heat exchanger 2 are fabricated by folding the folding plate blank 21 in the zigzag fashion, the first and second heat transfer plates S1 and S2 are disposed radiately from the center of the heat exchanger 2. Therefore, the distance between the adjacent first and second heat transfer plates S1 and S2 is a maximum at the radially outer peripheral portion contacting with the outer casing 6 and a minimum at the radially inner peripheral portion contacting with the inner casing 7. Therefore, the height of the first projections 22, the second projections 23, the first projection stripes $24_F$, $24_R$ and the second projection stripes $25_F$, $25_R$ is gradually increased from the radially inner side toward the radially outer side. Thus, the first and second heat transfer plates S1 and S2 can be disposed exactly radiately (see FIGS. 5 and 7).

By employing the above-described structure of the radiately folding plate, the outer and inner casings 6 and 7 can be concentrically located, and the axial symmetry of the heat exchanger 2 can be accurately maintained.

By constituting the heat exchanger 2 by a combination of the four modules $2_1$ of the same structure, it is possible to facilitate the manufacture of the heat exchanger 2 and to simplify the structure of the heat exchanger 2. By folding the folding plate blank 21 radiately and in the zigzag fashion to form the first and second heat transfer plates S1 and S2 in a continuous manner, the number of parts and the number of brazing points can be substantially reduced, but also the dimensional accuracy of the finished article can be enhanced, as compared to a construction with a large number of first heat transfer plates S1 independent from one another and a large number of second heat transfer plates S2 independent from one another are alternately brazed.

During operation of the gas turbine engine E, the pressure in the combustion gas passages 4 is relatively low, and the pressure in the air passages 5 is relatively high. Therefore, a flexural load is applied to the first and second heat transfer plates S1 and S2 by a difference between these pressures, but a sufficient rigidity capable of withstanding such load can be provided by the first and second projections 22 and 23 brought into abutment against each other and brazed to each other.

The surface areas of the first and second heat transfer plates S1 and S2 (i.e., the surface areas of the combustion gas passages 4 and the air passages 5) are increased by the first and second projections 22 and 23, and moreover, the flows of the combustion gas and the air are agitated, thereby enabling an enhancement in heat exchange efficiency.

Further, the front and rear ends of the heat exchanger 2 are cut into the angle shape, and the combustion gas passage inlet 11 and the air passage outlet 16 are defined along two sides of the angle shape at the front end of the heat exchanger 2, while the combustion gas passage outlet 12 and the air passage inlet 15 are defined along two sides of the angle shape at the rear end of the heat exchanger 2. Therefore, large sectional areas of flow paths in the inlets 11 and 15 the outlets 12 and 16 can be insured to suppress the pressure loss to the minimum, as compared with the case where inlets 11 and 15 and outlets 12 and 16 are defined without cutting of the front and rear ends of the heat exchanger 2 into an angle shape.

Moreover, since the inlets 11 and 15 and the outlets 12 and 16 are defined along the two sides of the angle shape, the flow paths of the combustion gas and the air flowing into and out of the combustion gas passages 4 and the air passages 5 can be smoothed to further reduce the pressure loss, but also the ducts connected to the inlets 11 and 15 and the outlets 12 and 16 can be disposed to extend axially without being abruptly bent, thereby reducing the radial dimension of the heat exchanger 2.

Further, since the end plates 8 and 10 are brazed to the end faces at the tips of the front and rear ends of the heat exchanger 2 formed into the angle shape, the brazing area can be minimized to decrease the possibility of leakage of the combustion gas and the air due to a brazing failure. Moreover, it is possible to simply and reliably partition the inlets 11 and 15 and the outlets 12 and 16 while suppressing the decrease in opening areas of the inlets 11 and 15 and the outlets 12 and 16.

Figure 13:
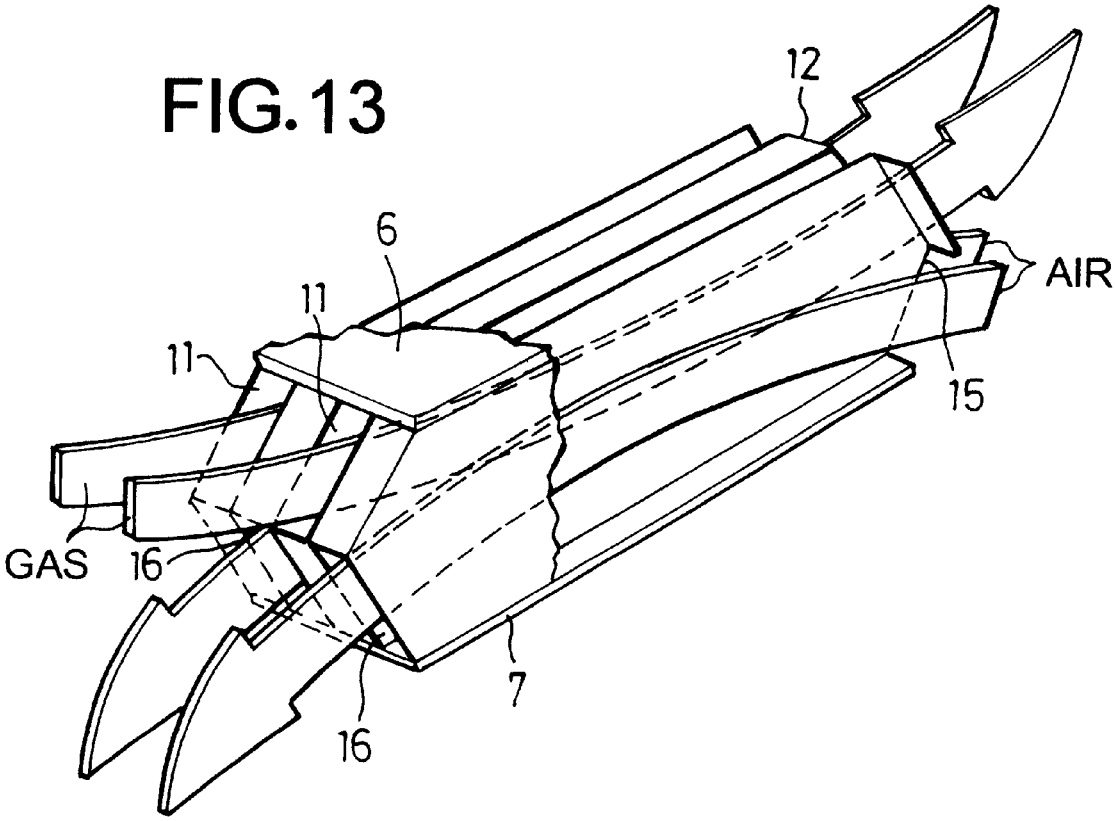
FIG. 13 is a diagram similar to FIG. 12, but according to a second embodiment of the present invention.

FIG. 13 shows a second embodiment of the present invention. In the second embodiment, the inlets 11 and outlets 12 of combustion gas passages 4 are defined at a radially outer side, and outlets 16 and inlets 15 of air passages 5 are defined radially inside of the inlets 11 and outlets 12. Thus, the combustion gas and the air flowing in the opposite directions intersect each other in the first embodiment, but the combustion gas and the air flowing in the opposite directions flow by each other in the second embodiment.

The other structures in the second embodiment are the same as in the first embodiment, and functions and effects similar to those in the first embodiment can be provided.

Although the embodiments of the present invention have been described in detail, it will be understood that the present invention is not limited to the above-described embodiments and various modifications in design may be made without departing from the spirit and scone of the invention defined in claims.

For example, the heat exchanger 2 for the gas turbine is engine E has been illustrated in the embodiments, but the present invention is also applicable to a heat exchanger for use in another device and apparatus. The first and second heat transfer plates S1 and S2 are necessarily not formed in the folded structure, and first and second independent heat transfer plates S1 and S2 maybe combined with each other. The heat exchanger 2 in each of the embodiments is of the axially symmetric type in which the heat transfer plates S1 and S2 are disposed radiately, but the features of claims are applicable to a box-type heat exchanger including heat transfer plates arranged in parallel to one another.

What is claimed is:

1. A heat exchanger comprising axially extending high-temperature and low-temperature fluid passages formed circumferentially alternately between axially-extending radial walls filling an annular space defined between a radially outer cylindrical wall and a radially inner cylindrical wall, said radial walls formed by folding a folding plate blank comprised of a plurality of first heat transfer plates and a plurality of second heat transfer plates connected alternately through folding lines, in a zigzag fashion, so that the first and second heat transfer plates are disposed radially between and engaging the radially outer and inner cylindrical walls, said high-temperature and low-temperature fluid passages being formed circumferentially alternately between the adjacent first and second heat transfer plates, high-temperature fluid passage inlets and high-temperature fluid passage outlets being formed to open into axially opposite ends of said high-temperature fluid passages, low-temperature fluid passage inlets and low-temperature fluid passage outlets being formed to open into axially opposite ends of said low-temperature fluid passages;

said high-temperature fluid passage inlets being formed by cutting axially opposite ends of said first and second heat transfer plates into an angle shape having two end edges, said high-temperature fluid passage inlets being formed by closing one of said two end edges at axially one end of each of said high-temperature fluid passages and opening the other end edge, said high-temperature fluid passage outlets being formed by closing one of said two end edges at the axially other end of each of said high-temperature fluid passages and opening the other end edge, said low-temperature fluid passage inlets being formed by closing said other end edge at the axially other end of each of said low-temperature fluid passages and opening said one end edge, said low-temperature fluid passage outlets being formed by closing said other end edge at the axially one end of each of said low-temperature fluid passage; and projection stripes formed on the adjacent first and second heat transfer plates to extend along said end edges, said end edges being closed by having tip ridges of said projection stripes of opposed heat transfer plates abut against each other.

2. A heat exchanger according to claim 1, further including a large number of projections which are formed on opposite surfaces of said first and second heat transfer plates and whose height is gradually increased outwards from the radially inner side, tip ends of the projections of the adjacent first and second heat transfer plates abut against each other.

3. A heat exchanger according to claim 2, wherein the tip ends of the projections abutting against each other are bonded to each other.

4. A heat exchanger according to claim 1, wherein the height of each of said projection stripes is gradually increased outwards from a radially inner side, and the tip ends of the projection stripes abutting against each other are bonded to each other.

5. A heat exchanger according to claim 4, further including a plurality of partially annular heat exchanger modules circumferentially coupled to one another.

6. A heat exchanger which is formed from a folding plate blank comprised of a plurality of first heat transfer plates and a plurality of second heat transfer plates connected alternately through first and second folding lines, and which comprises high-temperature fluid passages and low-temperature fluid passages formed alternately between the adjacent first and second heat transfer plates by folding said folding plate blank in a zigzag fashion, so that a space between the adjacent first folding lines is closed by bonding together of said first folding lines and a first wall plate and a space between the adjacent second folding lines is closed by bonding together of said second folding lines and a second wall plate, wherein said heat exchanger further includes high-temperature fluid passage inlets formed by cutting opposite ends of said first and second heat transfer plates in a flow path direction into an angle shape having two end edges and closing one of said two end edges at one end of each of said high-temperature fluid passages in the flow path direction by bonding together mutually engaging projection stripes embossed on said first and second heat transfer plates and opening the other end edge, high-temperature fluid passage outlets formed by closing one of said two end edges at the other end of each of said high-temperature fluid passages by bonding together mutually engaging projection stripes embossed on said first and second heat transfer plates and opening said other end edge, low-temperature fluid passage inlets formed by closing said one end edge at the other end of each of the low-temperature fluid passages in the flow path direction by bonding together mutually engaging projection stripes embossed on the first and second heat transfer plates and opening said other end edge, and low-temperature fluid passage outlets formed by closing said other end edge at one end of each of the low-temperature fluid passages by bonding together mutually engaging projection stripes embossed on said first and second heat transfer plates and opening said one end edge.

7. A heat exchanger comprising a plurality of first heat transfer plates and a plurality of second heat transfer plates formed by folding a folding plate blank on folding lines in a zigzag manner, said first and second heat transfer plates extending radially and axially throughout an annular space defined between a radially outer cylindrical wall and a radially inner cylindrical wall with said folding lines extending axially, said radially outer and inner cylindrical walls engaging said folding lines and forming a closure for openings formed between adjacent folding lines, high-temperature and low-temperature fluid passages being formed circumferentially alternately between the adjacent first and second heat transfer plates and said radially outer and inner cylindrical walls, said fluid passages extending generally axially, said first and second heat transfer plates each having axially opposite first and second ends, said first and second ends each having an angle shape with radially spaced first and second end edges, said high-temperature fluid passages each having an inlet formed at said first end by having said first end edge open and said second end edge closed, said high-temperature fluid passages each having an outlet formed at said second end by having said first end edge open and said second end edge closed, said low-temperature fluid passages each having an inlet formed at said second end by having said second end edge open and said first end edge closed, said low-temperature fluid passages each having an outlet formed at said first end by having said second edge end open and said first end edge closed, means engaging said first and second ends between said first and second end edges of each end for separating said fluid passage inlets and outlets in a radial direction; and projection stripes formed on the adjacent first and second heat transfer plates to extend along said first and second end edges, said projection stripes having tip ridges on opposed heat transfer plates that abut for closing selected said first and second end edges.

8. A heat exchanger according to claim 7, further including a multiplicity of projections formed on substantially the entire front and back surfaces of each of said first and second heat transfer plates, said projections having a height that gradually increases outwards from the radially inner cylindrical wall, and said projections having tip ends that abut on the adjacent first and second heat transfer plates.

9. A heat exchanger according to claim 8, wherein the tip ends of the projection abutting against each other are bonded to each other.

10. A heat exchanger according to claim 7, wherein each of said projection stripes has a height that gradually increases outwards from the radially inner cylindrical wall, and the tip ridges of the projection stripes abutting against each other are bonded to each other.

11. A heat exchanger according to claim 7, further including a plurality of partially annular segments of heat exchanger modules circumferentially coupled to one another.

12. A heat exchanger according to claim 7, wherein the radially outward said folding lines have a circumferential space between adjacent said outward folding lines and said outward folding lines are bonded to said outer cylindrical wall, and the radially inward said folding lines having a space between adjacent said inward folding lines and said inward folding lines are bonded to said inner cylindrical wall.

13. The heat exchanger of claim 7 wherein said first end edge on said first end is located radially outwardly of said second end edge on said first end, and said first end edge on said second end is located radially inwardly of said second end edge or, said second end.

14. The heat exchanger of claim 7 wherein said first end edge on said first end is located radially outwardly of said second end edge on said first end, and said first end edge on said second end is located radially outwardly of said second end edge on said second end.

* * * * *